US005241342A

United States Patent [19]

Asano et al.

[11] Patent Number: 5,241,342

[45] Date of Patent: Aug. 31, 1993

[54] IMAGE FORMING APPARATUS HAVING A CHARGING MEMBER AND MEANS FOR PROTECTING THE IMAGE BEARING SURFACE CHARGED BY THE CHARGING MEMBER

[75] Inventors: Masaki Asano, Amagasaki; Shuji Iino, Hirakata; Akihito Ikegawa, Sakai; Izumi Osawa, Ikeda, all of Japan

[73] Assignee: Minolta Camera Kabushiki Kaisha, Osaka, Japan

[21] Appl. No.: 888,137

[22] Filed: May 26, 1992

[30] Foreign Application Priority Data

May 29, 1991 [JP] Japan ..... 3-124379

[51] Int. Cl.[5] ..... G03G 15/02

[52] U.S. Cl. ..... 355/219; 361/221

[58] Field of Search ..... 355/219, 301, 269, 270; 361/221

[56] References Cited

U.S. PATENT DOCUMENTS 3,589,895 6/1971 Ville ..... 355/301

4,706,320 11/1987 Swift ..... 355/301

5,128,725 7/1992 Frankel et al. ..... 355/301

FOREIGN PATENT DOCUMENTS 59-37568 3/1984 Japan .

59-204858 11/1984 Japan .

59-204859 11/1984 Japan .

59-204860 11/1984 Japan .

3-103878 4/1991 Japan ..... 355/219

*Primary Examiner*—A. T. Grimley

*Assistant Examiner*—J. E. Barlow, Jr.

*Attorney, Agent, or Firm*—Burns, Doane, Swecker & Mathis

[57] ABSTRACT

In a printer, in which a fixed brush charger charges a surface of a photosensitive drum to form a charged area to be converted into an electrostatic latent image by an optical system, fine particles having a volumetric mean particle diameter of 5 to 20 μm are supplied to the brush charger, from upstream side, in a moving direction of surface of the photosensitive member, of the charger, the particles being adhered onto the surface of the photosensitive member with an adhesion density of 5 to 1000 pcs/cm$^2$.

10 Claims, 5 Drawing Sheets

IMAGE FORMING APPARATUS HAVING A CHARGING MEMBER AND MEANS FOR PROTECTING THE IMAGE BEARING SURFACE CHARGED BY THE CHARGING MEMBER

BACKGROUND OF THE INVENTION

1. Field of the Invention

The present invention relates to an electrophotographic image forming apparatus such as a printer, and more particularly to an image forming apparatus in which a fixed brush charger charges a surface of an image carrier to form a charged area, which is subjected to an image exposure to form an electrostatic latent image. The present invention also relates to a method for forming an image.

2. Description of the Related Art

Electrophotographic image forming apparatuses have employed several types of charging devices such as a corona charger and a brush charger which charge surfaces of image carriers such as photosensitive members to form electrostatic latent images. The brush chargers have attracted the attention, because they generate less ozone, which may deteriorate the surfaces of the photosensitive members and adversely affect the human bodies, as compared with the corona chargers. Particularly, the fixed brush chargers, which are fixed in the moving direction of the surfaces of the photosensitive members, have attracted the more attention, because they are simpler than rotary brush chargers.

However, if the fixed brush charger is used for the photosensitive member having a soft surface such as an organic photosensitive member, the photosensitive member may be shaved, because tip ends of brush fibers of the charger continuously contact the soft surface of the photosensitive member. This shaving generates fine powder having a particle diameter in a range from 0.1 to several microns from the photosensitive member. The fine powder adheres onto the brush fibers to reduce the charging performance, which may cause a noise on the image. That is; a small amount of charge is charged by portions of the brush fibers having a large amount of fine powder adhering thereto, and a large amount of charge is charged by portions of the brush fibers having a small amount of powder adhering thereto. As a result, a striped noise is generated on the image by the fine powder thus generated from the photosensitive member and adhering onto the fibers.

The above problem may be solved by appropriately separating the ends of the brush fibers of the brush charger from the surface of the photosensitive member so as to avoid continuous contact of particular brush fibers with a particular portion of the photosensitive member. For this purpose, following constructions or methods have been proposed. In the construction disclosed in the Japanese Laid-Open Patent Publication No. 59-37568, a plurality of brush chargers are disposed on a rotary support, and the rotary support is intermittently rotated for sequentially using the brushes. In the construction disclosed in the Japanese Laid-Open Patent Publication No. 59-204858, the photosensitive member is provided at its end with a cam, which is used to separate the brush charger from the photosensitive member during the stop of the photosensitive member. In the construction disclosed in the Japanese Laid-Open Patent Publication No. 59-204859, the photosensitive member is provided at its end with a cam touching with a roll on a shaft of a brush charger to operate the brush charger from the photosensitive member during the stop of the photosensitive member. In the construction disclosed in the Japanese Laid-Open Patent publication No. 59-204860, a pulley which cooperates with the rotating photosensitive member operates to contact the brush charger with the photosensitive member.

However, the above-noted constructions practically require large and complicated mechanisms, resulting in increased dimensions of the image forming apparatus. This cannot comply with the demand for the reduced dimensions and compact structures of the image forming apparatus in these days.

Accordingly, it is an object of the invention to provide an image forming apparatus, in which a surface of an image carrier such as a photosensitive member is charged by a brush charger to form a charged area, which is subjected to an image exposure to form an electrostatic latent image, and particularly to prevent adhesion of shaved powder of the image carrier onto brush fibers of the brush charger in a simple manner without remarkably increasing the dimensions of the image forming apparatus for obtaining a good image.

SUMMARY OF THE INVENTION

The inventors of the invention have researched to achieve the above-noted object and developed the present invention, in which the above-noted object is achieved by such a construction that fine particles are adhered onto a surface of an image carrier such as a photosensitive member to an extent which does not impede an image exposure, the fine particles are passed through a brush charger to shift brush fibers of the charger, whereby particular brush fibers are prevented from continuously contacting particular portions of the surface of the image carrier.

DETAILED DESCRIPTION OF THE INVENTION

The present invention provides an image forming apparatus, in which a surface of an image carrier such as an organic photosensitive member is charged by a brush charger to form a charged area, which is subjected to an image exposure to form an electrostatic latent image, comprising means which supplies fine particles having a volumetric mean particle diameter of 5 to 20 micrometers to a contact portion of the surface of the image carrier and the brush charger from an upstream side, in a moving direction of the surface of the image carrier, said particles being adhered onto the surface of the image carrier with an adhered density of 5 to 1000 particles per square centimeter.

The charging brush in the brush charger may be formed of a strip of a pile fabric 20, as shown in FIG. 4(A). The pile fabric may be formed of a base cloth 22 having a thickness of t and brush fibers 21, which are formed of electrically conductive fibers each having a thickness in a range from 3 to 10 deniers. As shown in FIGS. 4(B) and 4(C), the fibers 21 are woven into warps 22*a* of the base cloth in a W-form or V-form to have a height of H. The pile fabric 20 thus formed is coated at a rear surface of the base cloth 22 with electrically conductive adhesive to prevent the drop of the fibers, and then is cut into a length of L and a width of W. The cut strip of the fabric 20 is fixed to an electrically conductive plate 23 (e.g., of aluminium) with appropriate adhesive or a double-sided adhesive tape to form the brush charger.

The brush fibers may be made from various kinds of material having an appropriate electrical conductivity.

The conductive fibers may be metal wires, e.g., of tungsten, stainless steel, gold, platinum, iron, copper and aluminium.

The conductive fibers also may be made from electrically conductive resin.

The electrically conductive resin may be formed of resin such as rayon, nylon, acetate, cuprammonium, vinylidene, vinylon, ethylene fluoride, promix, benzoate, polyurethane, polyester, polyethylene, polyvinyl chloride, polychlal, polynosic, polypropylene and resistance adjusting agent dipersed therein. The resistance adjusting agent may be carbon black, carbon fiber, metal powder, metal whiskers, metal oxide, semiconductor and others. An appropriate resistance may be obtained by adjusting the amount of the resistance adjusting agent dispersed in the fiber. Instead of dispersion, the surface of the fiber may be covered with the resistance adjusting agent.

The image carrier in the invention may be of various types. For example, it may be an organic photosensitive member of a function-separated type which is manufactured as follows.

Photosensitive liquid is formed of $\tau$-type non-metal phthalocyanine at 1 weight part, polyvinyl butyral resin at 2 weight parts and tetrahydrofuran at 100 weight parts. This liquid is kept in a ball mill pot for 24 hours to be dispersed. The photosensitive liquid thus manufactured is applied to a base member, i.e., a cylindrical aluminium member of 30 mm in diameter and 240 mm in length by a dipping method, and then is dried to form a charge generating layer of 0.4 $\mu$m in thickness.

Then, liquid, which contains hydrazone compound having a following structural formula, is used.

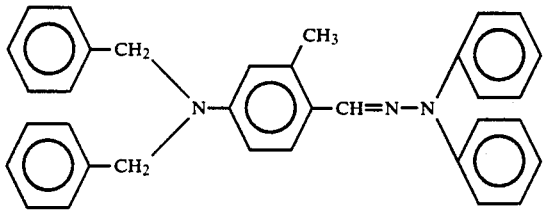

This liquid includes the above hydrazone compound at 8 weight parts, as well as orange pigment (Sumiplast Orange 12 manufactured by Sumitomo Kagaku Kabushiki Kaisha) at 0.1 weight part, and polycarbonate resin (Panlight L-1250 manufactured by Teijin Kasei Kabushiki Kaisha) at 10 weight parts which are dissolved into solvent of tetrahydrofuran at 180 weight parts. This liquid is applied to the charge generating layer by the dipping method, and then is dried to form a charge transmitting layer of 18 $\mu$m in thickness. In this manner, the photosensitive drum is manufactured.

In the image carrier in the invention, there is no restriction with respect to the material, and the image carrier may be the organic photosensitive member of the functionally separated type described before or a photosensitive member of a single layer structure. Various known materials other than those described before may be used for the charge generating material, charge transmitting material, binder resin and others. Also, inorganic material such as zinc oxide, cadmium sulfide, selenium alloy and amolphous silicone may be used.

A surface protective layer may be formed on the outermost surface of the photosensitive member. This protective layer may be formed of resin such as ultraviolet setting resin, cold setting resin and thermosetting resin. It also may be formed of resin in which resistance adjusting agent is dispersed in the above resin. Further, it may be formed of a thin film which is prepared by vacuum deposition, ion plating or the like of metal oxide or metal sulfide. Moreover, it may be formed of amolphous carbon film which is formed by plasma-polymerization of gas containing hydrocarbon.

The base member also may be formed of various materials having the electrical conductivity, and may be of a flat shape or a belt-like shape, depending on an imaging system.

If used light source is coherent light, the base member may be roughened or blackened to prevent so-called interference pattern.

The fine particles supplied to the brush charger may be formed from various kinds of materials if they do not adversely affect the image formation.

The volumetric mean particle diameter of the fine particle is preferably in a range from 5 $\mu$m to 20 $\mu$m. If it is smaller than 5 $\mu$m, it is impossible to prevent the striped noise in the image which may be generated by the shaving of the image carrier. If it is larger than 20 $\mu$m, the fine particles have excessively small adhesion to the surface of the image carrier, and thus cannot function to shift the brush fibers.

The adhesion density of the fine particles onto the surface of the image carrier is preferably in a range from 5 to 1000 particles per square centimeter (hereinafter, pcs/cm$^2$), and more preferably in a range from 50 to 500 pcs/cm$^2$. If the adhesion density of the fine particles are smaller than 5 pcs/cm$^2$, it is impossible to prevent the striped noise in the image generated by the shaving of the image carrier. If it is larger than 1000 pcs/cm$^2$, the sensitivity of the image carrier is reduced due to the light absorption and light scatter by the fine particles during the image exposure.

The means for controlling the adhesion density of the fine particles onto the surface of the image carrier may be formed of various kinds of fiber members, rubber members and elastic resin members which can contact the surface of the image carrier. The fiber members may be flannel, velvet, felt and other fabrics such as plain weave fabric. The rubber member may be made from urethane rubber, butadiene rubber, natural rubber and others. The elastic resin members may be made from the same material as various kinds of cleaning blades which are generally used for cleaning residual toner particles remaining on the surface of the image carrier after the transfer of the toner image onto a transfer member.

The means for supplying the fine particles to the image carrier may be formed of the cleaning device, of which principal purpose is to remove the residual toner from the surface of the image carrier. In this case, the cleaning blade in the cleaning device is used as the means for controlling the adhesion density of the fine particles on the surface of the image carrier, and developer passing through the blade is used as the fine particles. Alternatively, the apparatus may be provided with independent means which supplies the fine particles onto the surface of the image carrier while controlling the adhesion density.

According to the image forming apparatus and the charging apparatus of the present invention, the brush fibers in the brush charger are shifted by the fine particles, which are supplied to the brush charger from an upstream side, in the moving direction of the surface of the image carrier, and is adhered onto the surface of the image carrier such as a photosensitive member. Thereby, the particular brush fibers are prevented from continuously contacting the particular portions of the surface of the image carrier, so that the charging can be stably carried out without irregularity and thus the good image can be obtained.

The foregoing and other objects, features, aspects and advantages of the present invention will become more apparent from the following more detailed description of the present invention when taken in conjunction with the accompanying drawings.

DESCRIPTION OF THE PREFERRED EMBODIMENT

Embodiments of the invention will be described below.

Figure 1:
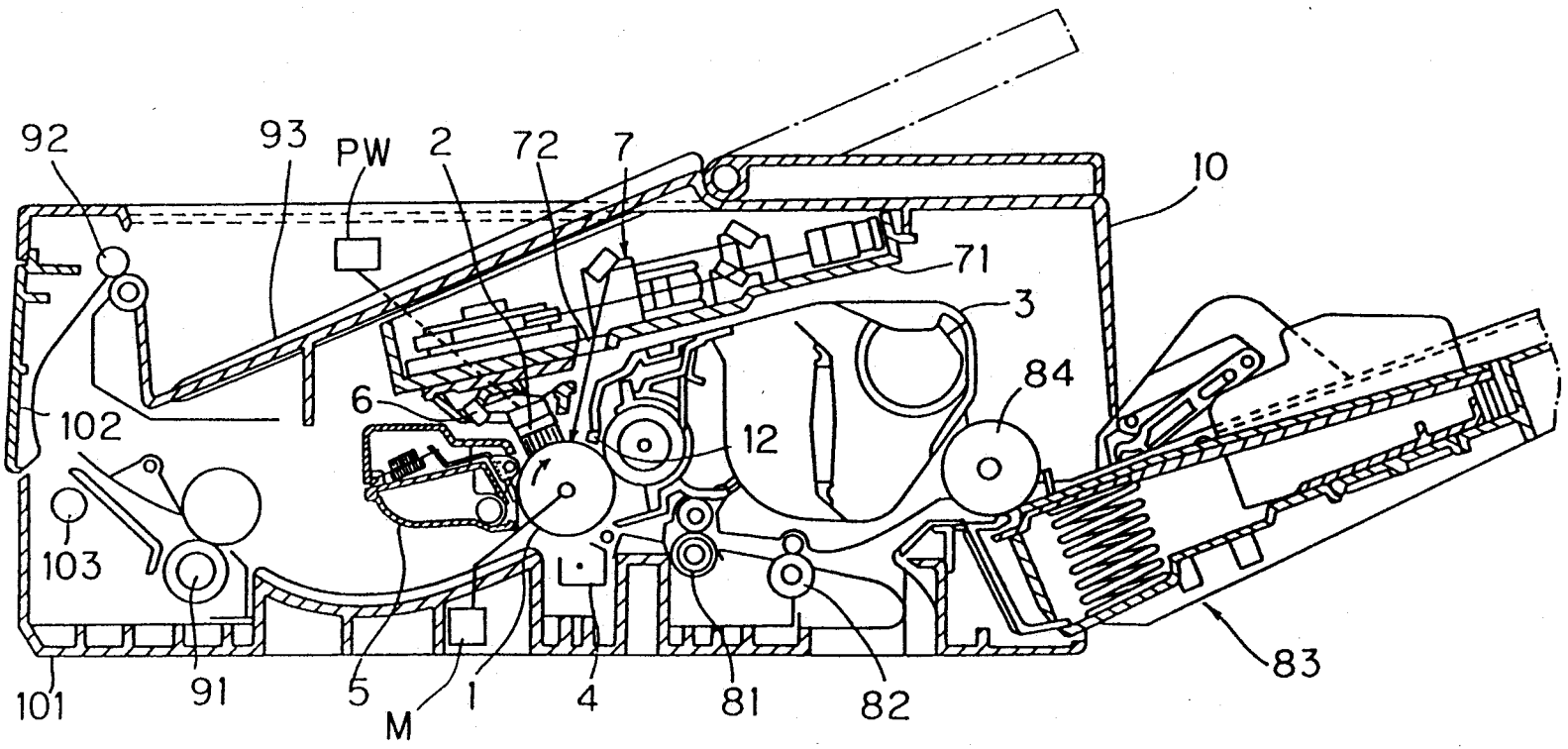
FIG. 1 is a cross section schematically showing a printer according to the invention.

In the embodiments described below, the invention is applied to a printer of which structures are schematically shown in FIG. 1. First, the printer shown in FIG. 1 will be described.

The printer shown in FIG. 1 is provided at its central portion with a photosensitive drum 1, i.e., electrostatic latent image carrier driven to rotate in a clockwise direction in the figure by a drive motor M. Around the drum 1, there are sequentially disposed a brush charger 2, a developing device 3, a transfer charger 4, a cleaning device 5 and an eraser 6.

Above the photosensitive drum 1, there is provided an optical system 7 including a housing 71 which accommodates a semiconductor laser generator, a polygon mirror, a toroidal lens, a half mirror, a spherical mirror, a return mirror, a reflection mirror and others. The housing 71 is provided at its floor with an exposure slit 72. The image exposure can be applied onto the photosensitive drum 1 through the exposure slit 72 and a space between the charger 2 and the developing device 3.

At the right side to the photosensitive drum 1 in the figure, there are sequentially disposed a timing roller pair 81, an intermediate roller pair 82 and a sheet feed cassette 83 to which a feed roller 84 is opposed. At the left side to the photosensitive drum 1 in the figure, there are sequentially disposed a fixing roller pair 91 and a discharge roller 92, to which a sheet discharge tray 93 is opposed.

The part and portions described above are mounted on a main body 10 of the printer. The main body 10 is formed of lower and upper units 101 and 102. The upper unit 102 carries the charger 2, developing device 3, cleaning device 5, eraser 6, optical system 7, upper roller of the timing roller pair 81, upper roller of the intermediate roller pair 82, feed roller 84, upper roller of the fixing roller pair 91, discharge roller pair 92 and sheet discharge tray 93. The upper unit is pivotable around a shaft 103 disposed at the left end portion of the printer so that the end at the sheet feeding side of this unit may be upwardly opened for the restoration from the jamming state and various kinds of maintenance.

The photosensitive drum 1 is a negatively chargeable photosensitive member of a functionally separated type which has the sensitivity to the long wave light. The construction and manufacturing method of this photosensitive member have already been described.

Figure 4A:
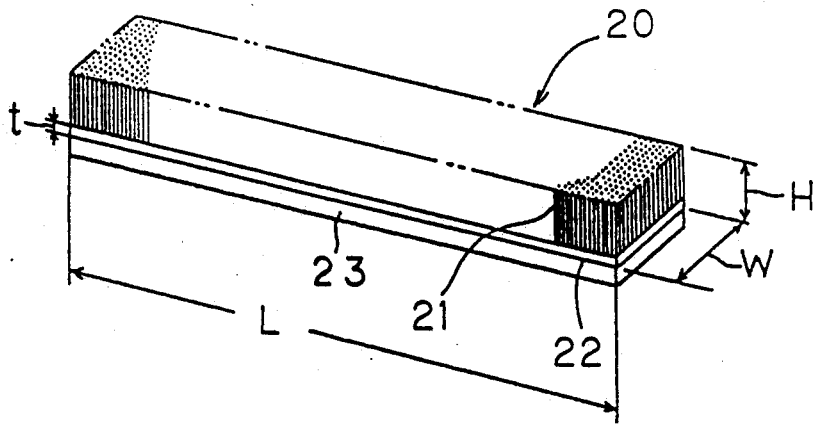
FIG. 4(A) is a perspective view of a brush charger.
Figure 4B:
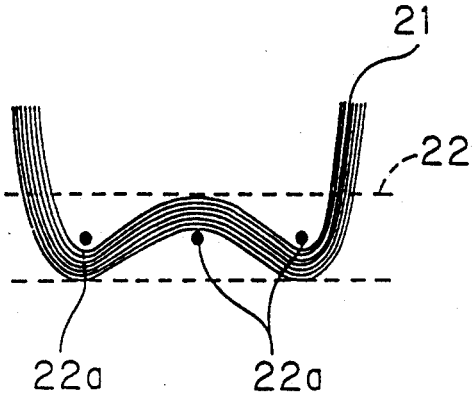
FIG. 4(B) shows a manner for weaving charging brush fibers in FIG. 4(A) into a base cloth.
Figure 4C:
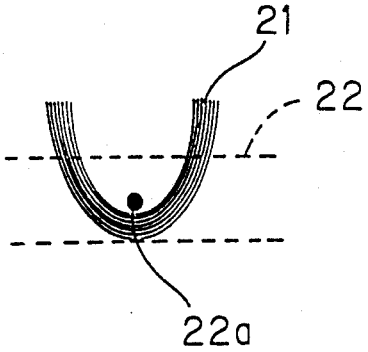
FIG. 4(C) shows another example of a manner for weaving brush fibers.

The brush charger 2 has the structures shown in FIG. 4(A), and includes electrically conductive rayon fibers 21 of 6 deniers. The rayon fiber 21 has an electrical resistivity of about $1\times10^5$ Ω·cm and contains conductive carbon powder at 12 wt.% with respect to the whole weight. As shown in FIG. 4(B), bundles, each including 100 fibers, are woven in a W-form into warps 22*a* of a base cloth 22 having a thickness t of about 1 mm, to obtain a fiber density of 15000 fibers/cm$^2$. The rear surface of the base cloth 22 is coated with electrically conductive adhesive, by which the base cloth 22 is fixed to a back plate 23 of aluminium. In this manner, three kinds of brush chargers are prepared. Brushes of these chargers have the same length L of 240 mm and the same height H of 5 mm, but have different widths of 5 mm, 7 mm and 10 mm, respectively. A voltage of −1.2 KV is applied to the brush charger 2 by a power supply PW to charge the surface of the photosensitive drum 1 uniformly to −800 V.

Brush hairs or fibers which can be used in the brush charger 2 are not restricted to the above described fibers, and may be preferably formed of various fibers having the thickness of 3–10 deniers and the density of 10000–100000 fibers/cm$^2$.

The fibers of the thickness less than 3 deniers may not achieve the sufficient strength of the brush and thus the uniform charging. If the thickness is more than 10 deniers, the charging may be instable. Therefore the brush fibers of 3–10 deniers are preferable. The density of the brush hairs or fibers is preferably in a range from 10000 to 100000 fibers/cm$^2$ in order to uniformly charge the whole surface of the photosensitive drum by the brush fibers having the above thickness. If the density is less than 10000 fibers/cm$^2$, the charged portion and non-charged portion is clearly distinguished, and the influence on the image cannot be ignored. If the density is more than 100000 fibers/cm$^2$, the interference between the brush fibers is increased, and the influence on the image cannot be ignored.

When the brush used in the invention includes the fibers of 3–10 deniers with the density of 10000–100000 fibers/cm$^2$, the fine particles according to the invention having the volumetric mean particle diameter of 5–20 μm must be supplied at the rate of 5–1000 pcs/cm$^2$ in order to prevent the previously described shaving or stripping of the photosensitive drum.

Now, the used fine particles will be specifically described below.

The toner used in the developing device 3 described before is of a negative chargeable type, and is manufactured from the following composition. The composition is formed of bisphenol A polyester resin at 100 weight parts, carbon black MA#8 (manufactured by Mitsubishi Kasei Kogyo Kabushiki Kaisha) at 5 weight parts, Bontron S-34 (manufactured by Orient Kagaku Kogyo Kabushiki Kaisha) at 3 weight parts, and Viscorl TS- 200 (manufactured by Sanyo Kasei Kogyo Kabushiki Kaisha) at 2.5 weight parts. This composition is kneaded, ground and classified to manufacture toner particles having a mean diameter of 10 μm and a distribution, in which 80 weight percents are included in a range of the particle diameters from 7 μm to 13 μm. Hydrophobic silica (Tanolux 500 manufactured by Talco Co.) at 0.75 weight percents is added as fluidization agent to the toner particles, and mixed and agitated by a homogenizer. Additionally, other types of toner having the volumetric mean particle diameters of 5 μm and 20 μm are prepared in the similar manner.

The toner thus manufactured is accommodated in the developing device 3 for reversal development under a developing bias of −300 V.

In this printer, the surface of the photosensitive drum is uniformly charged to a predetermined potential of −800V by the charger 2, and a charged area is subjected to the image exposure by the optical system 7 to form an electrostatic latent image. The electrostatic latent image thus formed is developed by the developing device 3 into a toner image, which is moved to a transfer region opposed to the transfer charger 4.

Meanwhile, a transfer sheet of paper is drawn by the feed roller 84 from the sheet feed cassette 83 through the intermediate roller pair 82 to the timing roller pair 81, from which the sheet is fed to the transfer region in synchronization with the toner image. In the transfer region, the transfer charger 4 transfers the toner image formed on the drum 1 to the transfer sheet. The transfer sheet moves to the fixing roller pair 91, at which the toner image is fixed, and then the sheet is discharged by the discharge roller pair 92 to the discharge tray 93.

After the transfer of the toner image, the toner remaining on the photosensitive drum 1 is cleaned off by the cleaning device 5, and the residual charge is erased by the eraser 6.

A system speed of the printer, i.e., a peripheral speed of the photosensitive drum 1 is 3.5 cm/sec.

Figure 2:
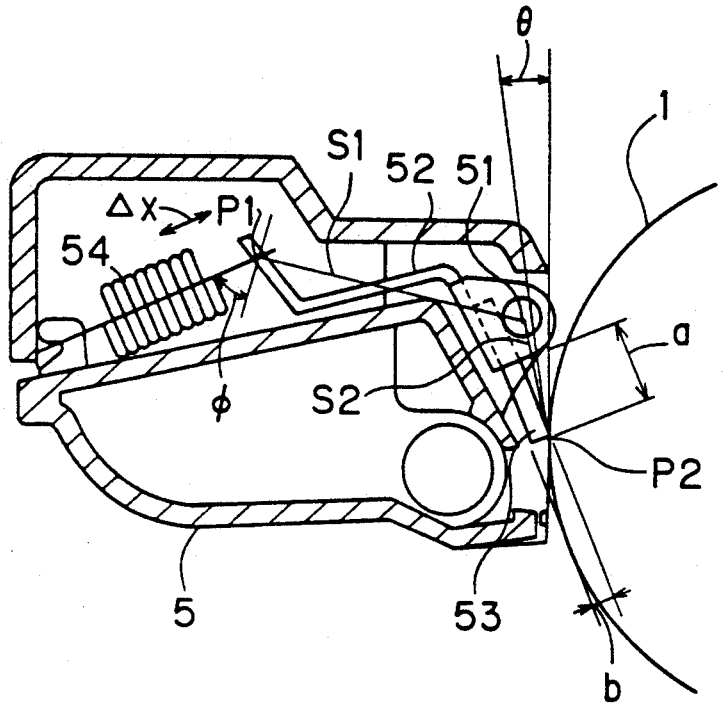
FIG. 2 is an enlarged cross section of a cleaning device.

FIG. 2 specifically shows the cleaning device 5. An arm 52, which is pivotable around a fulcrum 51, has one end supporting a cleaning blade 53. The rear end of the arm 52 is continuously pulled rearwardly by a spring 54, so that an end of the blade 53 contacts the photosensitive drum 1. A contact angle of $\theta$ is formed between tangent lines, which are tangential to the photosensitive drum 1 and the blade 53, respectively, and commonly extend through a contact point of the photosensitive drum 1 and the blade 53. A contact pressure PR (g/cm) of the blade 53 to the photosensitive drum 1 is $(k \cdot \Delta x \cdot \cos\theta \cdot S1/S2)/A$, wherein k indicates a spring constant (g/cm), Δx indicates an extended length (cm) of the spring, S1 indicates a distance (cm) between the fulcrum 51 and a force point P1, S2 indicates a distance (cm) between the fulcrum 51 and a point of application P2, and $\theta$ indicates an angle between a direction normal to a line segment S1 and a center line of the spring 54. "A" indicates a widthwise length (cm) of the blade in the axial direction of the photosensitive drum. In the figure, "a" indicates a projected length of the blade 53 when the blade is not in contact with the drum 1, and "b" indicates a thickness of the blade 53 when the blade is not in contact with the photosensitive drum 1.

In the printer described before, the cleaning device 5 also serves as fine particle supplying means which shifts the brush fibers of the charger 2, and the cleaning blade 53 thereof also serves as control means for controlling the adhesion density of the fine particles onto the drum surface. The toner used for the development serves also as the fine particles.

Embodiments and examples for comparison have been tested and evaluated, of which results are shown in tables 1∝4 described later. The used brush charger 2 is the same as that shown in FIG. 4(A) and includes the fibers of 6 deniers at the density of 15000 fibers/cm$^2$. The evaluation was carried out with various kinds of material of the blade 53 in the cleaning device 5 as well as various projected lengths a, blade thicknesses b, contact angles $\theta$ to the drum 1 and contact pressures. The evaluation was made with respect to amounts of the fine particles (toner) passed through the blade 53, the image noises, reduction of the charging sensitivities of the photosensitive drum and others. The evaluation was carried out in every cases under the same conditions of 20° C. and 65%RH.

Figure 3:
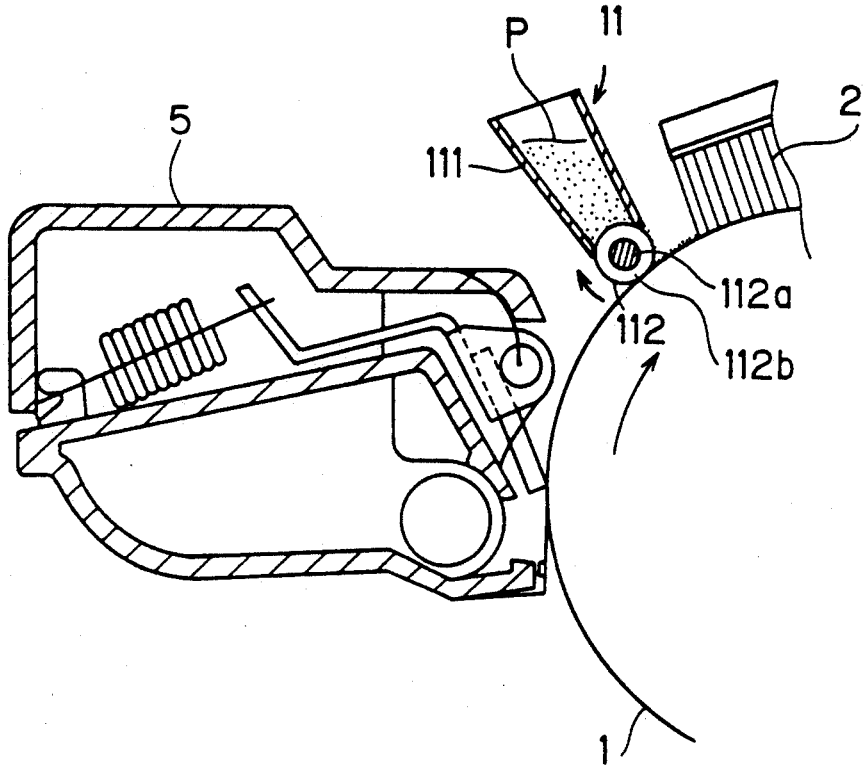
FIG. 3 shows an example of a device for supplying fine particles.

In another embodiment of the invention, the cleaning device 5 is constructed to achieve only its principal function, i.e., cleaning function, and a device 11 for supplying fine particles P is disposed between the cleaning device 5 and the brush charger 2, as shown in FIG. 3. This fine particle supplying device 11 includes a hopper 111 for accommodating the fine particles and a supply roller 112 disposed at a lower end opening of the hopper. The roller 112 contacts the surface of the photosensitive drum 1 with a predetermined contact pressure Pr (g/cm), and is driven to rotate clockwise in the figure at a predetermined peripheral speed CV by unillustrated drive means. Thereby, the fine particles P are supplied at a predetermined rate onto the surface of the photosensitive drum 1 and thus to the charger 2. The roller 112 includes a central portion **112*a* formed of an aluminium roller of 3 mm in diameter and flannel cloth 112*b*** of 1 mm in thickness wound therearound, and thus has an outer diameter of 5 mm.

As the fine particles P, the toner having a volumetric mean particle diameter of 10 μm is used. Also, transparent resin beads having a volumetric mean particle diameter of 10 μm are prepared. These beads are manufactured in the same manner as the previously described manufacturing method of the toner accommodated in the developing device 3, except for that the carbon black MA#8 is not used.

Also in connection with this supply of the fine particles by the roller, the amounts of the toner (beads) passed through the roller 112, image noises, reduction of the charging sensitivity of the photosensitive drum and others have been evaluated, using the brush charger 2 of 7 mm in width. The result is shown in Table 4 described later. The evaluation was carried out in every cases under the same conditions of 20° C. and 65%RH.

In the descriptions and tables discussed below, the evaluation of the striped image noises ($\sigma$-evaluations of $W_M$) is carried out for evaluating the performance of the brush chargers 2. That is; the irregularity of the charging caused by the adhesion of the fine particles generates in a direction perpendicular to the moving direction of the surface of the photosensitive drum 1. This irregularity of the charging remains as the irregularity of the surface potential (Vi) of the drum 1 even after the exposure of the image. Specifically, the drum 1 immediately after the charging by the charger 2 may locally have a portion having a higher surface potential (Vo), and this portion will have a higher potential (Vi) after the image exposure. When the reversal development is carried out in the printer, the portion having the lower potential (Vi) is developed with a larger amount of toner. Thus, the irregularity of the potential (Vo) causes the irregularity of the potential (Vi), and finally causes the irregularity of the image. One of the performances of the charger according to the invention relates to the condition of generation of this image irregularity. The evaluation of the levels of the image irregularity is carried out by the evaluation of the striped image noises.

Figure 5:
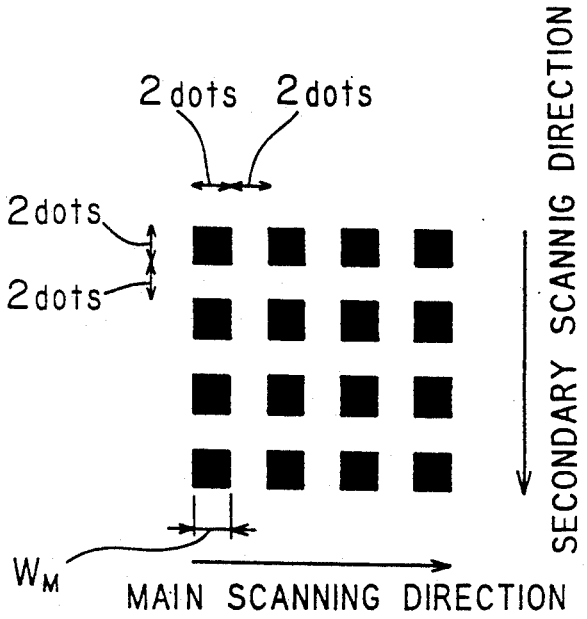
FIG. 5 shows an example of a pattern used for evaluation of a striped image noise.

The evaluation of the image noises is carried out as follows. The previously described printer is used. After charging the surface of the photosensitive drum 1 by the charger 2, a repetitive patter of 2 dot on (turn on) and 2 dot off (turn off) is written in the main scanning direction, and similarly the patter of 2 dot on and 2 dot off is written in the secondary scanning direction by the laser from the optical system 7, of which laser lighting timing is adjusted. Thereafter, a printer image shown in FIG. 5 is formed by the reversal development, transfer and fixing processes.

It is assumed that the small black solid pattern of 2 dots by 2 dots on the printed image has a maximum width of $W_M$ in the main scanning direction. The width $W_M$ of the 30 small black solid patterns which are continuous in the main scanning direction has a standard deviation of $\sigma$. Depending on the standard deviation $\sigma$, the image noises are ranked as follows.

| Standard Deviation $\sigma$ | Evaluation Mark |
|---|---|
| $0\ \mu m \leqq \sigma \leqq 20\ \mu m$ | ○ |
| $20\ \mu m < \sigma \leqq 40\ \mu m$ | Δ |
| $40\ \mu m < \sigma$ | X |

Large values of the standard deviation $\sigma$ indicate the fact that the width of the small black solid pattern in the main scanning direction deviates to a large extent in the main scanning direction. In the printed dot patterns described before, the deviation $\sigma$ more than 40 μm has been experientially recognized as an unpreferably strong noise. Therefore, the preferred value of $\sigma$ is lower than 40 μm. The value of $\sigma$ lower than 20 μm is further preferable, in which case the striped noise cannot be recognized. The circular mark indicates a preferable condition in which the noise is not recognized. The triangular mark indicates a condition in which the image noise is practically allowable, and the mark "X" indicates a condition in which the image noise is not practically allowed.

The reduction of the sensitivity of the surface of the photosensitive drum, which is caused by the existence of the fine particles supplied to the brush charger 2 on the surface of the photosensitive drum 1, was evaluated as follows. As shown in FIG. 1, a surface electrometer 12 is disposed between a path of laser and a developing sleeve of the device 3 to measure the surface potential (Vi) of the surface of the photosensitive drum 1, which has been charged to the initial potential Vo of −800 V, after the laser-exposure of the whole surface. The reduction of the sensitivity is evaluated as described below, based on the extent of the increase of the potential (Vi2) after the exposure, which is measured in such a case that the fine particles remain on the surface of the photosensitive drum 1, with respect to the pure potential (Vi1) after the exposure in such a case that the toner and beads are not interposed.

| Increased Value of Vi | Evaluation Mark |
|---|---|
| Increased value of Vi ≦ 10 V | ○ |

Reduction of the sensitivity is not substantially recognized, and the good image is obtained.

| | |
|---|---|
| 10 V < Increased value of Vi ≦ 20 V | Δ |

Slight reduction of the sensitivity and corresponding reduction of the image density or thinning of thin line patter are recognized, but they are practically allowed.

| | |
|---|---|
| 20 V < Increased value of Vi | x |

Reduction of the sensitivity and corresponding reduction of the image density or thinning of thin line patter are recognized, resulting in practically unpreferable image.

In the tables 1–4, "Notes 1–4" in the Total Evaluation ("TEV") means the following.

Note 1

The shaved powder of the photosensitive layer, which is generated by the sliding of the brush fibers on the photosensitive drum, adheres onto the brush fibers, resulting in a remarkable striped noise. Although the reduction of the sensitivity is not recognized, the level cannot be practically allowed with respect to the quality of image.

Note 2

The shaved powder of the photosensitive layer, which is generated by the sliding of the brush fibers on the photosensitive drum, adheres onto the brush fibers, resulting in a slight striped noise. However, practically allowable quality of image is obtained. The reduction of the sensitivity is not substantially caused, and is allowed.

Note 3

Neither the shaved powder of the photosensitive layer, which may be generated by the sliding of the brush fibers on the photosensitive drum, nor the striped noise are recognized. The reduction of the sensitivity is in the ignorable level, and excellent printed image can be obtained.

Note 4

Neither the shaved powder of the photosensitive layer, which may be generated by the sliding of the brush fibers on the photosensitive drum, nor the striped noise are recognized. The slight reduction of the sensitivity is recognized, but is in the practically allowable level.

Note 5

Neither the shaved powder of the photosensitive layer, which may be generated by the sliding of the brush fibers on the photosensitive drum, nor the striped noise are recognized. The reduction of the sensitivity is recognized. The amount of the passed fine particles is excessively large. The reduction of the density and the thinning of thin lines are unpreferably recognized in the image.

In the tables 1–4, the hardness and repulsive elasticity of the material of the blades for controlling the supply of fine particles are based on Japanese Industrial Standard K 6301-1975.

Embodiments of the invention will be further discussed together with examples for comparisons with reference to the tables 1–4.

WITH RESPECT TO EMBODIMENTS 1–6 AND EXAMPLES 1–4 FOR COMPARISON 5000 sheets of A4 size are printed out, using the above described toner having the volumetric mean particle diameter of 10 μm as the toner in the developing device 3. The print patterns are of 2 dot on and 2 dot off, and are printed on the whole area of the sheet of the A4 size. Only the contact pressure of the blade for controlling the adhesion density of the fine particles is adjusted to supply the passing fine particles to the brush charger 2, as shown in the tables 1 and 2.

The example 1 for comparison employs the same blade a those which have been used in the conventional printers and copying machines and are so-called cleaning devices capable of complete cleaning. Little toner remains on the surface of the photosensitive drum 1 (1 pc/10 $cm^2$), and the toner particles are not substantially supplied toward the brush charger 2. After the print out of the 5000 sheets, a large amount of fine powder of 1 to several microns in diameter, which is probably the shaved powder of the photosensitive drum, adheres to the brush fibers, and the surface of the brush charger contacting the photosensitive drum is distinctly viewed to be discolored to pale yellow.

The examples 2–4 for comparison are the conditions which are not preferable for the conventional cleaning device. It can be found that reduction of the contact pressure increases the amount of the passed fine particles, and the shift effect of the brush fibers in the charger 2 improves the striped noise.

In the example 2 for comparison, adhesion of pale yellow powder is slightly recognized, and the evaluation of the striped noise is "x". However, in the embodiments of numbers 1 and more in which the amount of the fine particles is 5 pcs/$cm^2$ or more, the striped noise is ranked by the triangle or circular mark. In the embodiments of numbers 3 and more in which the amount of the fine particles is 50 pcs/$cm^2$ or more, the striped noise is ranked by the circular mark.

Meanwhile, the reduction of the sensitivity of the surface of the photosensitive drum due to the residual toner is in the rank of the circular mark if the amount is 500 pcs/$cm^2$ (embodiment 5) or less. A case of 1000 pcs/$cm^2$ (embodiment 6) which is evaluated by the triangle mark is the allowable limit, and the values in the examples 3 and 4 exceeding it are evaluated to be in the rank of "x" mark.

WITH RESPECT TO EMBODIMENT 7

As compared with the example 2 for comparison, the thickness of the blade is reduced, and the other settings are the same. Fine vibration of the blade caused by the sliding on the photosensitive member 1 is increased, and consequently, the amount of the passed particles is increased. The striped noise is evaluated to be good, and it can be understood that the effect of the invention does not depend on the thickness of the blade but depends on the amount of the passed fine particles.

WITH RESPECT TO EMBODIMENT 8

As compared with the example 2 for comparison, the projected length of the blade is increased, and the other settings are the same. Fine vibration of the blade caused by the sliding on the photosensitive member 1 is increased, and consequently, the amount of the passed particles is increased. The striped noise is evaluated to be good, and it can be understood that the effect of the invention does not depend on the projected length of the blade but depends on the amount of the passed fine particles.

WITH RESPECT TO THE EMBODIMENTS 9 AND 10

As compared with the embodiment 1, the repulsive elasticity and hardness of the blade are changed to adjust the amount of the passed fine particles. It can be seen that good result can be obtained in a range from 5 to 1000 pieces.

WITH RESPECT TO EMBODIMENTS 11 AND 12

As compared with the embodiment 3, which achieves the best effect, the width of the brush charger 2 is changed. The levels of the striped noise and reduction of the sensitivities are substantially the same as those of the embodiment 3 in view of the measurement error. It can be seen that the present invention can be applied to the brush charger including the charging brush of the different width.

WITH RESPECT TO EMBODIMENT 13

The settings of the blade are similar to those of the example 1 for comparison, so that the passed fine particle is not generated in the blade section. A fine particle supply roller is disposed as shown in FIG. 3, and the toner of the same amount as that in the embodiment 3 is supplied to the surface of the photosensitive drum 1. The result is substantially the same as those of the embodiment 3 in view of the measurement error, and it can be understood that the effect of the invention does not depend on the manner for supplying the toner.

WITH RESPECT TO THE EMBODIMENTS 14 AND 15

As compared with the toner in the embodiment 3, the classification point is changed. The embodiment 14 uses the toner having a mean particle diameter of 5 μm and a distribution in which 80 weight percents are included in a range of the particle diameter from 3 μm to 7 μm. The embodiment 15 uses the toner having a mean diameter of 20 μm and a distribution in which 80 weight percents are included in a range of the particle diameter from 17 μm to 24 μm.

Since the diameters of the toner particle are different, the numbers of the passed fine particles are different from that in the embodiment 3. However, as can be seen from the comparison with the embodiment 10, in which the number of the passed fine particles is similar to that (400 particles) in the embodiment 14, there is no difference in the effect between the embodiments 10 and 14. Also, it can be seen from the comparison with the embodiments 3, 8, 11, 12 and 13 in which the numbers is similar to that (44 particles) in the embodiment 15, there is not difference in the effect.

As can be seen from the foregoing, the effect of the invention can be obtained with the particles of the diameters from 5 to 20 μm.

WITH RESPECT TO THE EMBODIMENT 16

The roller supply system in FIG. 3 is used to supply fine resin particles, which are manufactured in the same method for the previously described toner used in the developing device 3 without using the carbon black MA#8. The result is substantially the same as that of the embodiment 13 in view of the measurement error. It has been found that the interposed particles achieve the effect of the invention. Further, in view of the fact that the particles do not contain the carbon black, which is different from the toner, it is additionally found that the increase of Vi is lower than that in the embodiment 13.

In the following tables, a term "EVI" means the evaluation of the image noise, and specifically standard deviation $\sigma$ of the image width $W_M$ after the print out of 5000 sheets. A term "EVS" means the evaluation of the Vi-increase and reduction of the sensitivity, and the term "TEV" means the total evaluation after the print out of 5000 sheets.

TABLE 1

Example 1 for Comparison

Brush Charger: Type A, Width = 7 mm
System for Controlling Adhesion Density of Particles: Blade
Controlling Conditions:

| | |
|---|---|
| Material: | Urethane Rubber (hardness = 67, repulsive elasticity = 25) |
| Configuration: | Projected Length = 7 mm, Blade Thickness = 2 mm |
| Setting: | Contact Angle = 17° Contact Pressure = 3.22 (g/cm) Contact pressure is changed from Embodiment 1. |

Amount of Passed Fine Particles: 1 pcs/cm$^2$ (10 μm toner)
EVI: $\sigma$ = 67 μm (X)
EVS: 0 V (◯)
TEV: (X) (Note 1)

Example 2 for Comparison

Brush Charger: Type A, Width = 7 mm
System for Controlling Adhesion Density of Particles: Blade
Controlling Conditions:

| | |
|---|---|
| Material: | Urethane Rubber (hardness = 67, repulsive elasticity = 25) |
| Configuration: | Projected Length = 7 mm, Blade Thickness = 2 mm |
| Setting: | Contact Angle = 17° Contact Pressure = 1.61 (g/cm) Contact pressure is changed from Embodiment 1. |

Amount of Passed Fine Particles: 3.0 pcs/cm$^2$ (10 μm toner)
EVI: $\sigma$ = 54 μm (X)
EVS: 0 V (◯)
TEV: (X) (Note 1)

Embodiment 1

Brush Charger: Type A, Width = 7 mm
System for Controlling Adhesion Density of Particles: Blade
Controlling Conditions:

| | |
|---|---|
| Material: | Urethane Rubber (hardness = 67, repulsive elasticity = 25) |
| Configuration: | Projected Length = 7 mm, Blade Thickness = 2 mm |
| Setting: | Contact Angle = 17° Contact Pressure = 1.22 (g/cm) |

Amount of Passed Fine Particles: 5.0 pcs (10 μm toner)
EVI: $\sigma$ = 40 μm (Δ)
EVS: 2 V (◯)
TEV: (Δ) (Note 2)

Embodiment 2

Brush Charger: Type A. Width = 7 mm
System for Controlling Adhesion Density of Particles: Blade
Controlling Conditions:

| | |
|---|---|
| Material: | Urethane Rubber (hardness = 67, repulsive elasticity = 25) |
| Configuration: | Projected Length = 7 mm, Blade Thickness = 2 mm |
| Setting: | Contact Angle = 17° Contact Pressure = 0.90 (g/cm) Contact pressure is changed from Embodiment 1. |

Amount of Passed Fine Particles: 17 pcs/cm$^2$ (10 μm toner)
EVI: $\sigma$ = 27 μm (Δ)
EVS: 2 V (◯)
TEV: (Δ) (Note 2)

Embodiment 3

Brush Charger: Type A, Width = 7 mm
System for Controlling Adhesion Density of Particles: Blade
Controlling Conditions:

| | |
|---|---|
| Material: | Urethane Rubber (hardness = 67, repulsive elasticity = 25) |
| Configuration: | Projected Length = 7 mm, Blade Thickness = 2 mm |
| Setting: | Contact Angle = 17° Contact Pressure = 0.68 (g/cm) Contact pressure is changed from Embodiment 1. |

Amount of Passed Fine Particles: 50 pcs/cm$^2$ (10 μm toner)
EVI: $\sigma$ = 18 μm (◯)
EVS: 3 V (◯)
TEV: (◯) (Note 3)

TABLE 2

Embodiment 4

Brush Charger: Type A, Width = 7 mm
System for Controlling Adhesion Density of Particles: Blade
Controlling Conditions:

| | |
|---|---|
| Material: | Urethane Rubber (hardness = 67, repulsive elasticity = 25) |
| Configuration: | Projected Length = 7 mm, Blade Thickness = 2 mm |
| Setting: | Contact Angle = 17° Contact Pressure = 0.43 (g/cm) Contact pressure is changed from Embodiment 1. |

Amount of Passed Fine Particles: 290 pcs/cm$^2$ (10 μm toner)
EVI: $\sigma$ = 11 μm (◯)
EVS: 6 V (◯)
TEV: (◯) (Note 3)

Embodiment 5

Brush Charger: Type A, Width = 7 mm
System for Controlling Adhesion Density of Particles: Blade
Controlling Conditions:

| | |
|---|---|
| Material: | Urethane Rubber (hardness = 67, repulsive elasticity = 25) |
| Configuration: | Projected Length = 7 mm, Blade Thickness = 2 mm |
| Setting: | Contact Angle = 17° Contact Pressure = 0.36 (g/cm) Contact pressure is changed from Embodiment 1. |

Amount of Passed Fine Particles: 500 pcs/cm$^2$ (10 μm toner)
EVI: $\sigma$ = 9 μm (◯)
EVS: 10 V (◯)
TEV: (◯) (Note 3)

Embodiment 6

Brush Charger: Type A, Width = 7 mm
System for Controlling Adhesion Density of Particles: Blade
Controlling Conditions:

| | |
|---|---|
| Material: | Urethane Rubber (hardness = 67, repulsive elasticity = 25) |
| Configuration: | Projected Length = 7 mm, Blade Thickness = 2 mm |
| Setting: | Contact Angle = 17° Contact Pressure = 0.28 (g/cm) Contact pressure is changed from Embodiment 1. |

Amount of Passed Fine Particles: 1000 pcs/cm$^2$ (10 μm toner)
EVI: $\sigma$ = 7 μm (◯)
EVS: 20 V (Δ)
TEV: (Δ) (Note 4)

Example 3 for Comparison

Brush Charger: Type A, Width = 7 mm
System for Controlling Adhesion Density of Particles: Blade
Controlling Conditions:

| | |
|---|---|
| Material: | Urethane Rubber |

TABLE 2-continued

| | |
|---|---|
| | (hardness = 67, repulsive elasticity = 25) |
| Configuration: | Projected Length = 7 mm, Blade Thickness = 2 mm |
| Setting: | Contact Angle = 17° |
| | Contact Pressure = 0.21 (g/cm) |
| | Contact pressure is changed from Embodiment 1. |

Amount of Passed Fine Particles: 2050 pcs/cm$^2$ (10 μm toner)
EVI: σ = 6 μm (◯)
EVS: 45 V (X)
TEV: (X) (Note 5)

Example 4 for Comparison

Brush Charger: Type A, Width = 7 mm
System for Controlling Adhesion Density of Particles: Blade
Controlling Conditions:

| | |
|---|---|
| Material: | Urethane Rubber (hardness = 67, repulsive elasticity = 25) |
| Configuration: | Projected Length = 7 mm, Blade Thickness = 2 mm |
| Setting: | Contact Angle = 17° |
| | Contact Pressure = 0.16 (g/cm) |
| | Contact pressure is changed from Embodiment 1. |

Amount of Passed Fine Particles: 3500 pcs/cm$^2$ (10 μm toner)
EVI: σ = 6 μm (◯)
EVS: 67 V (X)
TEV: (X) (Note 5)

TABLE 3

Embodiment 7

Brush Charger: Type A, Width = 7 mm
System for Controlling Adhesion Density of Particles: Blade
Controlling Conditions:

| | |
|---|---|
| Material: | Urethane Rubber (hardness = 67, repulsive elasticity = 25) |
| Configuration: | Projected Length = 7 mm, Blade Thickness = 0.5 mm |
| Setting: | Contact Angle = 17° |
| | Contact Pressure = 1.61 (g/cm) |
| | Projected length is changed from Example 2 for Comparison. |

Amount of Passed Fine Particles: 10 pcs/cm$^2$ (10 μm toner)
EVI: σ = 32 μm (◯)
EVS: 2 V (◯)
TEV: (Δ) (Note 2)

Embodiment 8

Brush Charger: Type A, Width = 7 mm
System for Controlling Adhesion Density of Particles: Blade
Controlling Conditions:

| | |
|---|---|
| Material: | Urethane Rubber (hardness = 67, repulsive elasticity = 25) |
| Configuration: | Projected Length = 16 mm, Blade Thickness = 2 mm |
| Setting: | Contact Angle = 17° |
| | Contact Pressure = 1.61 (g/cm) |
| | Projected length is changed from Example 2 for comparison. |

Amount of Passed Fine Particles: 30 pcs/cm$^2$ (10 μm toner)
EVI: σ = 23 μm (Δ)
EVS: 2 V (◯)
TEV: (Δ) (Note 2)

Embodiment 9

Brush Charger: Type A, Width = 7 mm
System for Controlling Adhesion Density of Particles: Blade
Controlling Conditions:

| | |
|---|---|
| Material: | Urethane Rubber (hardness = 67, repulsive elasticity = 43) |
| Configuration: | Projected Length = 7 mm, Blade Thickness = 2 mm |
| Setting: | Contact Angle = 17° |
| | Contact Pressure = 0.21 (g/cm) |
| | Projected length is changed from Embodiment 1. |

Amount of Passed Fine Particles: 640 pcs/cm$^2$ (10 μm toner)
EVI: σ = 8 μm (◯)
EVS: 18 V (Δ)
TEV: (Δ) (Note 4)

Embodiment 10

TABLE 3-continued

Brush Charger: Type A, Width = 7 mm
System for Controlling Adhesion Density of Particles: Blade
Controlling Conditions:

| | |
|---|---|
| Material: | Urethane Rubber (hardness = 67, repulsive elasticity = 43) |
| Configuration: | Projected Length = 7 mm, Blade Thickness = 2 mm |
| Setting: | Contact Angle = 19° |
| | Contact Pressure = 0.21 (g/cm) |
| | Contact angle is changed from Embodiment 1. |

Amount of Passed Fine Particles: 390 pcs/cm$^2$ (10 μm toner)
EVI: σ = 10 μm (◯)
EVS: 8 V (◯)
TEV: (◯) (Note 3)

TABLE 4

Embodiment 11

| | |
|---|---|
| Brush Charger: | Type B, Width = 5 mm (The width of the charger of Embodiment 3 is changed to narrow brush charger) |

System for Controlling Adhesion Density of Particles: Blade
Controlling Conditions:

| | |
|---|---|
| Material: | Urethane Rubber (hardness = 67, repulsive elasticity = 25) |
| Configuration: | Projected Length = 7 mm, Blade Thickness = 2.0 mm |
| Setting: | Contact Angle = 17° |
| | Contact Pressure = 0.68 (g/cm) |

Amount of Passed Fine Particles: 54 pcs/cm$^2$ (10 μm toner)
EVI: σ = 17 μm (◯)
EVS: 3 V (◯)
TEV: (◯) (Note 3)

Embodiment 12

| | |
|---|---|
| Brush Charger: | Type C, Width = 10 mm (The width of the charger of Embodiment 3 is changed to wide brush charger) |

System for Controlling Adhesion Density of Particles: Blade
Controlling Conditions:

| | |
|---|---|
| Material: | Urethane Rubber (hardness = 67, repulsive elasticity = 25) |
| Configuration: | Projected Length = 7 mm, Blade Thickness = 2.0 mm |
| Setting: | Contact Angle = 17° |
| | Contact Pressure = 0.68 (g/cm) |

Amount of Passed Fine Particles: 52 pcs/cm$^2$ (10 μm toner)
EVI: σ = 18 μm (◯)
EVS: 3 V (◯)
TEV: (◯) (Note 3)

Embodiment 13

| | |
|---|---|
| Brush Charger: | Type A, Width = 7 mm |

System for Controlling Adhesion Density of Particles: Roller
Controlling Conditions:

| | |
|---|---|
| Material: | flannel (fabric thickness = 1 mm) |
| Configuration: | (aluminium core (ϕ3 mm), whole dia. = 5 mm)) |
| Setting: | Peripheral speed = 10 (mm/sec) |
| | Counter drive |
| | Contact pressure = 0.2 g/cm |

Amount of Passed Fine Particles: 56 pcs/cm$^2$ (10 μm toner)
(Conditions of embodiment 3 are conducted with flannel roller.)
EVI: σ = 17 μm (◯)
EVS: 3 V (◯)
TEV: (◯) (Note 3)

Embodiment 14

| | |
|---|---|
| Brush Charger: | Type A, Width = 7 mm |

System for Controlling Adhesion Density of Particles: Blade
Controlling Conditions:

| | |
|---|---|
| Material: | Urethane Rubber (hardness = 67, repulsive elasticity = 25) |
| Configuration: | Projected Length = 7 mm, Blade Thickness = 2 mm |
| Setting: | Contact Angle = 17° |
| | Contact Pressure = 0.68 (g/cm) |

Amount of Passed Fine Particles: 400 pcs/cm$^2$ (5 μm toner)
(The toner of Embodiment 3 is conducted with small diameter toner.)
EVI: σ = 10 μm (◯)
EVS: 8 V (◯)
TEV: (◯) (Note 3)

TABLE 4-continued

| | |
|---|---|
| Embodiment 15 | |
| Brush Charger: | Type A, Width = 7 mm |
| System for Controlling Adhesion Density of Particles: Blade | |
| Controlling Conditions: | |
| Material: | Urethane Rubber (hardness = 67, repulsive elasticity = 25) |
| Configuration: | Projected Length = 7 mm, Blade Thickness = 2 mm |
| Setting: | Contact Angle = 17° Contact Pressure = 0.68 (g/cm) |
| Amount of Passed Fine Particles: 44 pcs/cm$^2$ (20 μm toner) (The toner of Embodiment 3 is conducted with large diameter toner.) | |
| EVI: $\sigma$ = 21 μm (Δ) | |
| EVS: 3 V (◯) | |
| TEV: (Δ) (Note 2) | |
| Embodiment 16 | |
| Brush Charger: | Type A, Width = 7 mm |
| System for Controlling Adhesion Density of Particles: Roller | |
| Controlling Conditions: | |
| Material: | flannel (fabric thickness = 1 mm) |
| Configuration: | (aluminium core (ϕ3 mm), whole dia. = 5 mm)) |
| Setting: | Peripheral speed = 10 (mm/sec) Counter drive Contact pressure = 0.2 g/cm |
| Amount of Passed Fine Particles: 56 pcs/cm$^2$ (10 μm toner) (Conditions of embodiment 3 are conducted with flannel roller.) | |
| EVI: $\sigma$ = 17 μm (◯) | |
| EVS: 0 V (◯) | |
| TEV: (◯) (Note 3) | |

As described hereinabove, the present invention can provide the image forming apparatus, in which the surface of the image carrier is charged by the fixed brush charger to form the charged area to be subjected to the image exposure to form the electrostatic latent image, and which can prevent adhesion of the shaved powder of the image carrier onto the brush fibers of the brush charger in a simple manner without remarkably increasing the dimensions of the image forming apparatus for obtaining the good image.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. An image forming apparatus comprising:
an endless shaped photosensitive member;
means for rotating the photosensitive member;
a contact charger being in contact with a surface of the rotating photosensitive member;
means for applying a voltage to the contact charger to charge the surface of the photosensitive member;
means for forming an electrostatic latent image on the surface of the photosensitive member by exposing the charged photosensitive member;
means for developing the latent image with toner particles having a volumetric means particle diameter of 5 to 20 micrometers;
means for transferring the developed toner particles from the photosensitive member to a recording sheet; and
means disposed at the downstream side of the transferring means with respect to the rotating direction of the photosensitive member for removing residual toner particles from the surface of the photosensitive member while allowing residual toner particles on the surface of the photosensitive member with an adhered density of 5 to 1000 particles per square centimeter to remain on the surface at the downstream side of the removing means with respect to the rotating direction of the photosensitive member in order to convey the remaining toner particles to a contact portion at which the contact charger is in contact with the surface of the photosensitive member.

2. An image forming apparatus as claimed in claim 1 wherein said contact charger comprises a plurality of fibers having a thickness of 3 to 10 deniers and has a fiber fill density of $1\times10^4$ to $1\times10^5$ fibers per square centimeter.

3. An image forming apparatus as claimed in claim 1 wherein said removing means comprises:
a blade made of elastic material; and
means for pressing the blade against the surface of the photosensitive member.

4. An image forming apparatus comprising:
an endless shaped photosensitive member;
means for rotating the photosensitive member;
a contact charger being in contact with a surface of the rotating photosensitive member;
means for applying a voltage to the contact charger to charge the surface of the photosensitive member;
means for forming an electrostatic latent image on the surface of the photosensitive member by exposing the charged photosensitive member;
means for developing the latent image with toner particles;
means for transferring the developed toner particles from the photosensitive member to a recording sheet;
means disposed at the downstream side of the transferring means with respect to the rotating direction of the photosensitive member for removing residual toner particles from the surface of the photosensitive member; and
means disposed at the downstream side of the removing means with respect to the rotating direction of the photosensitive member, for applying fine particles having a volumetric mean particle diameter of 5 to 20 micrometers onto the surface of the photosensitive member with an adhered density of 5 to 1000 particles per square centimeter at the downstream side of the removing means with respect to the rotating direction of the photosensitive member in order to convey the fine particles to a contact portion at which the contact charger is in contact with the surface of the photosensitive member.

5. An image forming apparatus as claimed in claim 4 wherein said contact brush comprises a plurality of fibers having a thickness of 3 to 10 deniers and has a fiber fill density of $1\times10^4$ to $1\times10^5$ fibers per square centimeter.

6. An image forming apparatus comprising:
an endless shaped photosensitive member;
means for rotating the photosensitive member;
a brush being in contact with a surface of the rotating photosensitive member;
means for applying a voltage to the brush to charge the surface of the photosensitive member;
means for forming an electrostatic latent image on the surface of the photosensitive member by exposing the charged photosensitive member;

means for developing the latent image with toner particles having a volumetric means particle diameter of 5 to 20 micrometers;

means for transferring the developed toner particles from the photosensitive member to a recording sheet; and means disposed at the downstream side of the transferring means with respect to the rotating direction of the photosensitive member for removing residual toner particles from the surface of the photosensitive member while allowing residual toner particles on the surface of the photosensitive member with an adhered density of 5 to 1000 particles per square centimeter to remain on the surface at the downstream side of the removing means with respect to the rotating direction of the photosensitive member in order to convey the remaining toner particles to a contact portion at which the brush is in contact with the surface of the photosensitive member.

7. An image forming apparatus as claimed in claim 6 wherein said brush comprises a plurality of fibers having a thickness of 3 to 10 deniers and has a fiber fill density of $1\times10^4$ to $1\times10^5$ fibers per square centimeter.

8. An image forming apparatus as claimed in claim 6 wherein said removing means comprises:

a blade made of elastic material; and means for pressing the blade against the surface of the photosensitive member.

9. An image forming apparatus comprising:

an endless shaped photosensitive member;

means for rotating the photosensitive member;

a brush being in contact with a surface of the rotating photosensitive member;

means for applying a voltage to the brush to charge the surface of the photosensitive member;

means for forming an electrostatic latent image on the surface of the photosensitive member by exposing the charged photosensitive member;

means for developing the latent image with toner particles;

means for transferring the developed toner particles from the photosensitive member to a recording sheet;

means disposed at the downstream side of the transferring means with respect to the rotating direction of the photosensitive member for removing residual toner particles from the surface of the photosensitive member; and means, disposed at the downstream side of the removing means with respect to the rotating direction of the photosensitive member, for applying fine particles having a volumetric mean particle diameter of 5 to 20 micrometers onto the surface of the photosensitive member with an adhered density of 5 to 1000 particles per square centimeter at the downstream side of the removing means with respect to the rotating direction of the photosensitive member in order to convey the fine particles to a contact portion at which the brush is in contact with the surface of the photosensitive member.

10. An image forming apparatus as claimed in claim 9 wherein said brush comprises a plurality of fibers having a thickness of 3 to 10 deniers and has a fiber fill density of $1\times10^4$ to $1\times10^5$ fibers per square centimeter.

* * * * *